US005169134A

United States Patent [19]

Ishiguro et al.

[11] Patent Number: 5,169,134

[45] Date of Patent: Dec. 8, 1992

[54] SORTER WITH SHEET ALIGNING MEMBER

[75] Inventors: Kuniaki Ishiguro; Keichi Kinoshita, both of Toyokawa, Japan

[73] Assignee: Minolta Camera Kabushiki Kaisha, Osaka, Japan

[21] Appl. No.: 717,999

[22] Filed: Jun. 20, 1991

[30] Foreign Application Priority Data

Jun. 23, 1990 [JP] Japan ..... 2-165399

[51] Int. Cl.[5] ..... B42B 2/00; B65H 39/02

[52] U.S. Cl. ..... 270/53; 270/58

[58] Field of Search ..... 270/53, 58, 52, 37

[56] References Cited

U.S. PATENT DOCUMENTS

| | | | |
|---|---|---|---|
| 3,995,748 | 12/1976 | Looney | 270/53 |
| 4,083,550 | 4/1978 | Pal | 270/53 |
| 4,368,972 | 1/1983 | Naramore | 355/14 SH |
| 4,376,529 | 3/1985 | George | 270/53 |
| 4,411,515 | 10/1983 | Kukucka et al. | 355/14 SH |
| 4,925,171 | 5/1990 | Kramer et al. | 270/53 |
| 4,928,941 | 5/1990 | Uto et al. | 270/53 |
| 4,946,153 | 8/1990 | Kinoshita et al. | 270/53 |
| 4,986,520 | 1/1991 | Shido | 270/53 |
| 5,108,081 | 4/1992 | Russel et al. | 270/37 |
| 5,108,082 | 4/1992 | Shea et al. | 270/37 X |
| 5,129,640 | 7/1992 | Kosaka et al. | 270/53 |

FOREIGN PATENT DOCUMENTS 23160 1/1990 Japan ..... 270/53

*Primary Examiner*—John T. Kwon
*Assistant Examiner*—John Ryznic
*Attorney, Agent, or Firm*—Willian Brinks Olds Hofer Gilson & Lione

[57] ABSTRACT

A sheet sorting device having a plurality of bins arranged vertically for accommodating sheets transported by a sheet transporting device and a sheet adjusting member provided in a vertical direction with respect to the sheet transporting device. One of the bins which faces a sheet aligning member is slid horizontally thereto by a moving mechanism so as to align a sheet accommodated in each bin by the sheet aligning member by pushing the sheet to an aligning reference portion formed by adjacent two sides of each bin. The sheet sorting device further has a stapler in the vicinity of the sheet aligning member to staple the sheets aligned by the sheet aligning member. At least either the bins or the aligning member and sheet transporting device is capable of being elevated up and down so as to transport sheets to each bin by the sheet transport device while the sheet aligning member aligns the sheet transported to the bin one by one.

14 Claims, 3 Drawing Sheets

SORTER WITH SHEET ALIGNING MEMBER

BACKGROUND OF THE INVENTION

1. Field of the Invention

The present invention relates to a sorter, in detail, a sorter which sorts sheets discharged by an image forming apparatus such as an electrophotographic copier, laser printer and the like to a plurality of bins.

2. Background of the Invention

Recently sorters of the above-mentioned type have been provided which are capable of not only sorting sheets but also stapling or punching sheets or the like. In the process of stapling sheets, it is required to align the sheets accommodated in each bin to a predetermined position in advance. Conventionally a sheet aligning system has been proposed which comprises a pivotable aligning rod penetrating all bins to press the sheets accommodated in each bin to an alignment reference plate thereby. Further, a system has also been proposed which rotates a paddle wheel comprising elastic blades in one direction to align sheets at an aligning corner on a tray.

However, the sheet aligning system with the alignment rod may cause poor alignment when the sheets are curled and thus includes a problem of lacking reliability. Further, it is required to control a pivotal stroke of the alignment rod to be changeable in accordance with sheet size.

On the other hand, the system with a paddle wheel is, in case of being applied to a sorter which sorts sheets to a plurality of bins, required to be provided on each bin. This causes a complication of structure of an apparatus and inefficiency of space.

SUMMARY OF THE INVENTION

The main object of the present invention is to provide a sorter having reliability on aligning sheets.

Another object of the present invention is to provide a sorter capable of setting aligning means to a plurality of bins with less space.

These and other objects of the present invention are accomplished by providing a sorter comprising a plurality of bins each of which has an aligning reference portion formed by two sides thereof adjacent to each other, sheet transporting means for transporting sheets to each bin, moving means for moving said each bin to a sheet aligning portion in a substantially horizontal direction, aligning means for aligning sheets by pressing a sheet to the side of said aligning reference portion and elevating means for moving either said sheet aligning means or said bins up and down.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PRESENT EMBODIMENTS

An embodiment of a sorter related to the present invention will be explained as follows with reference to drawings attached herewith. The following embodiment is applied to a staple sorter providing a function as a stapler.

Figure 1:
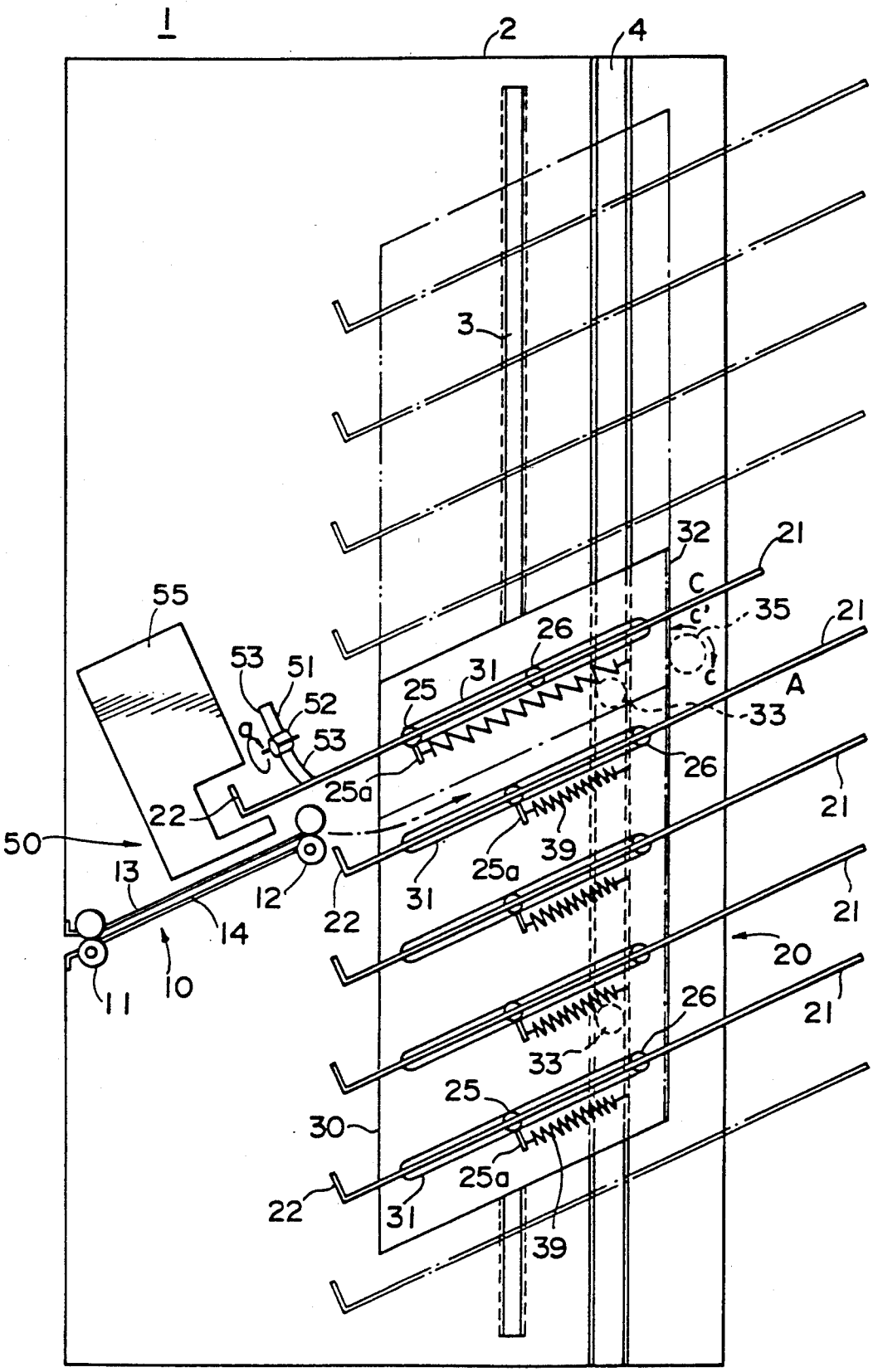
FIG. 1 is an illustration showing an internal construction of a staple sorter of one embodiment related to the present invention.

In FIG. 1 staple sorter 1 mainly comprises sheet transporting portion 10, bin unit 20 and align/staple portion 50.

The sheet transporting portion 10 comprises a pair of receiving rollers 11 for receiving sheets discharged from an unillustrated main body of an image forming apparatus, a pair of sending rollers 12 for sending out the sheets to each bin 21, and transporting guide boards 13, 14.

Align/staple portion 50 includes paddle wheel 51 and electric stapler 55. The paddle wheel 51 is formed by attaching elastic paddles 53 to shaft 52 and is rotatably driven in a direction of an arrow a by an unillustrated rotary driving means.

Figure 2:
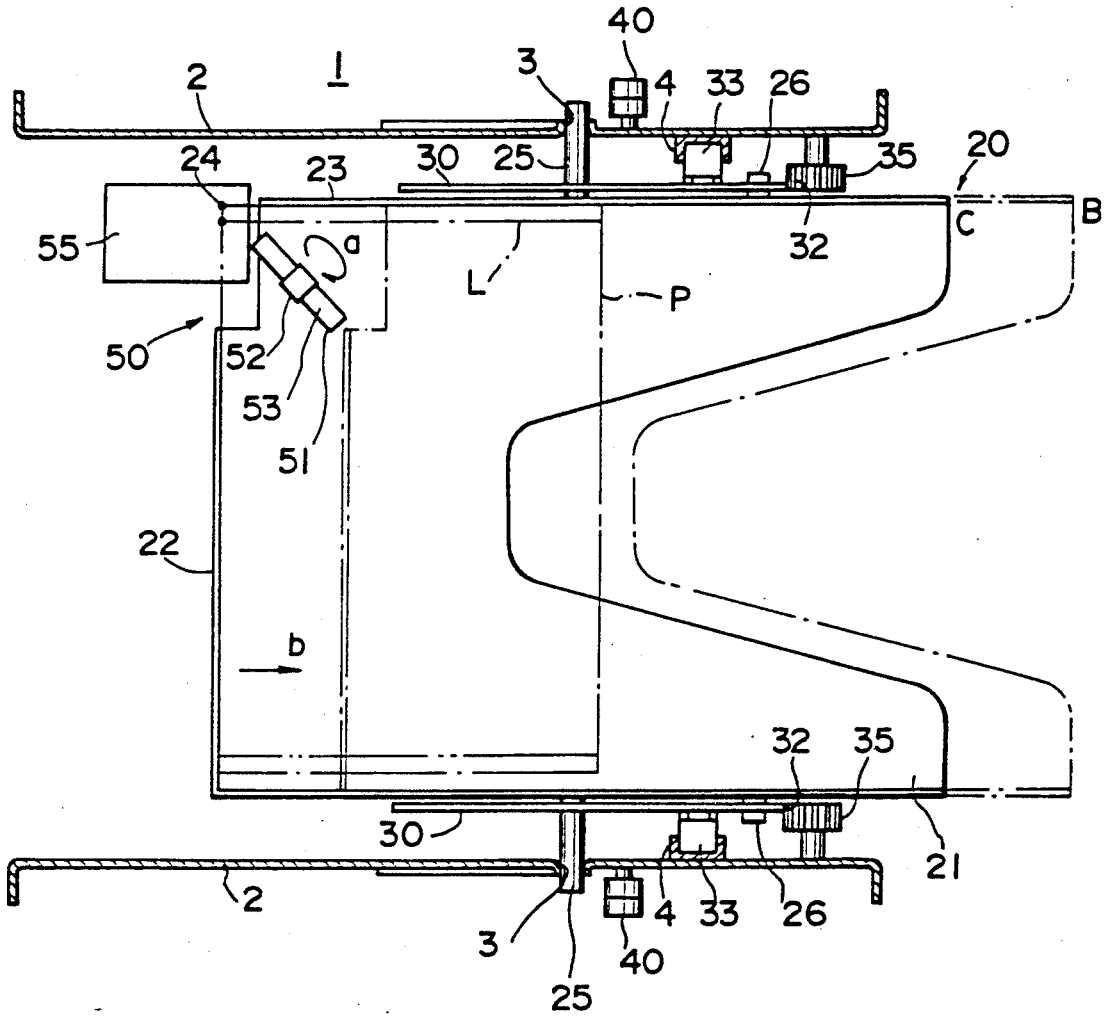
FIG. 2 is a plain view of the staple sorter shown in FIG. 1.

Bin unit 20 has bins arranged in five stages at regular intervals and holding means for holding each bin 21 at a fore side as well as a back side. Each bin 21, as shown in FIG. 2, has a large lacking portion at a leading portion with respect to sheet accommodating direction (referring to an arrow b) for taking out sheets, trailing edge stopper 22 at a trailing edge as a reference plate for aligning the trailing edge of the sheets and side stopper 23 provided at the back side as a reference plate for aligning the side of the sheets. Each bin comprises guide pins 25 and 26 which project at the fore side and back side two each. Said guide pins are slidably engaged with slide guide openings 31 which are formed inclinationally on holding plates 30 and slidable in the guide openings 31 inclinationally. Further, the guide pins 25 engage an elevating guide opening 3 formed on sorter frames 2 in a vertical direction.

The holding plate 30 has lack 32 notched at one end surface thereof so as to engage with pinion 35. At the outside of the holding plate 30 guide rollers 33 are rotatably provided so as to engage with elevating guide rail 4 which is disposed at each sorter frame 2 in a vertical direction. Accordingly, the bin unit 20 integrally elevates with the guide rollers 33 which is guided along the elevating guide rails 4 by rotating the pinion 35 backwardly and forwardly by an unillustrated rotary driving means.

On the other hand, as shown in FIG. 1, coil springs 39 are stretched between projections 25*a* on the guide pins 25 and the holding plate 30. Each bin 21 is stressed to the right side of FIG. 1 by the spring power of the spring 39 and arranged at a sheet accommodating position A. The sheet accommodating position A is the position of the bin 21 of second stage shown by a solid line in FIG. 1. Each bin 21 rises one stage intermittently by rotating pinion 35 a predetermined amount in a proper direction (in a direction of an arrow C) every time one sheet which is being processed is accommodated, then slides in a direction reverse to the sheet accommodating direction b from an align/staple preparing position B (shown by a dash and dot line) and is set to align/staple position C (the position of the bin 21 of the first stage shown by a solid line in FIG. 1).

Figure 3:
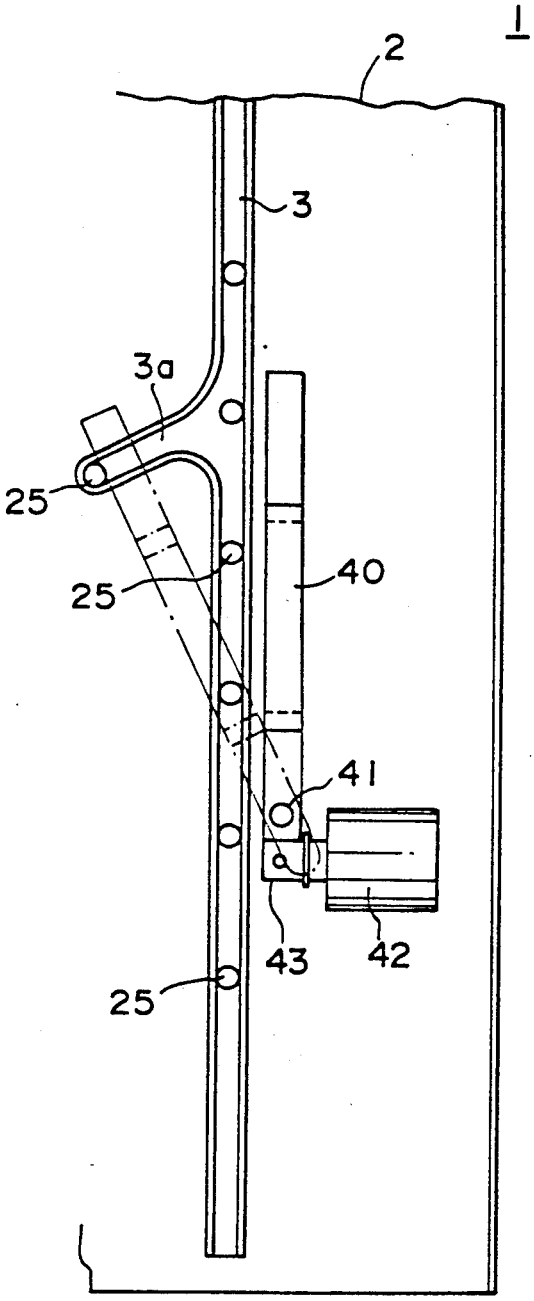
FIG. 3 is a front view of bin slide driving means of the staple sorter shown in FIG. 1.

In the present embodiment as shown in FIG. 3, provided are arm 40 and solenoid 42 as a driving means for sliding the bin, and branch portion 3*a* branched from the elevating guide opening 3 with which the guide pins 25 engage. The arm 40 is set pivotally on fulcrum 41. The lower edge part thereof is connected with plunger 43 of the solenoid 42 and the upper edge part thereof faces one of the guide pins 25. When the solenoid is off, the arm 40 is upright and the upper edge part thereof is a little away from the guide pin 25. When the solenoid 42 is on, the plunger 43 retracts and the arm 40 pivots leftward in the drawing so as to press one of the guide pins 25 by the upper edge part thereof. In consequence, the guide pin 25 slides along the branch portion 3*a* branched from the guide opening 3 and at the same time, the guide pins 25 and 26 slide the guide opening 31 on the holding plate 30 so as to set the bin 21 to an alignment/staple position C.

In this state, the positional relation among the paddle wheel 51, the stapler 55 and the bin 21 is shown by a solid line in FIG. 2. The paddle wheel 51 and the stapler 55 are positioned at the corner of opposite rear edge portion of the bin 21. Sheets P are accommodated on the bin 21 with the one side being referred to by a dash and dot line L, forced to an aligning corner portion 24 by the rotation of the paddle wheel 51 in the direction of an arrow a, and then aligned with the rear edge stopper 22 and the side stopper 23 as reference lines. The aligning corner portion 24 has a lack portion so as to position the binding portion of the stapler 55 which binds the aligned sheets.

The explanation will be followed of an operation of the staple sorter having the above-mentioned construction.

Sorting process is accomplished as follows.

(A1) At the first stage of the sorting process, the bin unit 20 is set to a home position where the bin 21 of the first stage receives a sheet from a pair of rollers 12.

(A2) The first copy sheet bearing the image of the first original is discharged to and accommodated in the bin 21 of the first stage from a pair of rollers 12.

(A3) The bin unit 20 is raised by the rotation of the pinion 35 in the direction of an arrow c a predetermined amount. Then the bin 21 of the first stage and the bin 21 of the second stage are set to the align/staple preparing position B and the sheet accommodating position A respectively.

(A4) The arm 40 is pivoted by turning the solenoid 42 on and the bin 21 of the first stage slides to the aligning/staple position C.

(A5) The paddle wheel 51 is driven to rotate in the direction of an arrow a all the time during the sorting process. Sheet P on the bin 21 is aligned with the rear edge stopper 22 and the side stopper 23.

(A6) When the alignment is finished, the bin 21 of the first stage is returned to the align/staple preparing position B.

(A7) The second sheet is accommodated to the bin 21 of the second stage in parallel with the execution of the abovementioned process (A3) to (A6).

(A8) Said process (A3) to (A7) is repeated a predetermined number of times (Copy number, In this embodiment maximum "5").

(A9) When the sheet accommodate/aligning process is finished, the bin unit 20 is descended by the reversal rotation of the pinion 35 in the direction of an arrow c' so as to return to the home position (A1) mentioned before.

(A10) Said process (A1) to (A9) is repeated till the copy sheets corresponding to all originals are accommodated in the bins 21 and aligned.

Stapling process is executed as follows:

(B1) After the completion of said sorting process (the bin unit 20 is at the home position), the bin unit 20 is raised one stage.

(B2) The solenoid 42 is turned on to slide the bin 21 of the first stage from the align/staple preparation position B to the align/staple position C. The paddle wheel 51 is also driven to rotate in the direction of the arrow a all the time during the stapling process.

(B3) The stapler 55 is turned on and the sheets on the bin 21 of the first stage are bound.

(B4) The solenoid 42 is turned off and the bin 21 of the first stage is returned to the align/staple preparation position B.

(B5) Said process (B1) to (B4) is repeated the predetermined number of times.

(B6) When the stapling process is finished to the bin 21 accommodating the sheet of the predetermined number, the bin unit 20 is returned to the home position.

As described above, according to the sorting process and the stapling process of the present embodiment, because each bin 21 is slid to the align/staple position C every time one sheet is accommodated onto the bin 21 and the sheet is aligned with the rear edge stopper 22 and the side stopper 23 as a reference by the paddle wheel 51 provided at the aligning corner portion, in other words, because pressing power for alignment is operated to the sheet at the aligning corner potion 24, reliability for alignment is superior and even if sheets of various sizes are accommodated in the bin 21, there is no need to change a control system of the paddle wheel 51. Further, because each bin 21 is raised and moved to the align/stapling position C one by one, just one paddle wheel 51 and stapler 55 are required, respectively. Thus, space can be used effectively and construction and control of an apparatus are simplified.

The sorter related to the present invention is not limited to that of said embodiment but is capable of being modified in the range of the point thereof.

For example, it is possible to fix the position (height) of each bin 21 and integrate a pair of sending rollers 12, the paddle wheel 51 and stapler 55 as a unit so as to execute accommodation and alignment of sheets first and then stapling them at every bin by elevating said unit intermittently along the rear edge portion (sheet receiving side) of each bin 21.

Though the paddle wheel 51 is driven to rotate all the time during the sorting and stapling processes in the aforementioned embodiment, it can be arranged to be retractable upward. In this case, the paddle wheel is descended to the position shown by a solid line in FIG. 1 and rotated in case of sheet alignment only, and otherwise, retracted upward without rotating. Or the elastic paddles 53 may be halted in the position parallel to the bin 21 without touching to sheets when the bin 21 is slid, and it may be rotated in case of sheet alignment only.

Instead of the stapler 55, punching means or binding means such as a clip may be arranged.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

We claim:

1. A sheet sorting device comprising:

a plurality of bins arranged vertically;

sheet transporting means for transporting sheets to said bins;

moving means for moving said bins in a substantially horizontal direction to a sheet alignment position;

sheet aligning means for aligning the sheets transported to each bin at the sheet alignment position; and elevating means for elevating at least either said plurality of bins or said sheet transporting means and sheet aligning means such that sheets are transported to each bin by said sheet transporting means while said sheet aligning means aligns the sheet transported to said each bin one by one.

2. The sheet sorting device as claimed in claim 1 further comprising stapling means disposed in the vicinity of said sheet aligning means for stapling the sheets aligned by said sheet aligning means.

3. The sheet sorting device as claimed in claim 1, wherein each bin has an alignment reference portion formed by adjacent two sides thereof and said sheet aligning means aligns the sheets by pressing the sheets to said reference portion.

4. A sheet sorting device comprising:

a plurality of bins arranged in a vertical direction, each of said plurality of bins having an alignment reference portion formed by adjacent two sides thereof;

sheet transporting means for transporting sheets to said bins;

sheet aligning means disposed in a vertical direction with respect to said sheet transporting means for aligning sheets transported to each bin with said alignment reference portion by pressing the sheets to said reference portion one by one;

first moving means for moving the bin which opposes said sheet aligning means in a substantially horizontal direction toward said sheet aligning means; and second moving means for moving at least either said plurality of bins or said sheet transporting means and sheet aligning means in a vertical direction such that sheets are transported to each bin by said sheet transporting means while said sheet aligning means aligns the sheet transported to said each bin one by one.

5. The sheet sorting device as claimed in claim 4 further comprising stapling means disposed in the vicinity of said sheet aligning means for stapling the sheets aligned by said sheet aligning means.

6. The sheet sorting device as claimed in claim 5 wherein said sheet aligning means comprises a paddle wheel formed by a shaft and radially-arranged paddles for pressing the sheets by the rotation thereof.

7. The sheet sorting device as claimed in claim 4 wherein said plurality of bins are supported on a supporting plate as a unit and said first moving means comprises a first guide opening extended toward said sheet aligning means in a substantially horizontal direction and a push member so as to push said supporting plate along the first guide opening.

8. The sheet sorting device as claimed in claim 7 wherein said second moving means includes a second guide opening extended in a vertical direction so as to move said supporting plate therealong, wherein said first guide opening is branched from said second guide opening.

9. A sheet storing device comprising:

a plurality of bins movably arranged in a vertical direction one upon another;

sheet transporting means for transporting sheets to said bins;

guide means comprising a first guide portion for guiding said bins in a vertical direction and a second guide portion for guiding one of said bins in a substantially horizontal direction, said second guide portion extending from a first location for positioning said one of said bins to be substantially aligned with said plurality of vertically arranged bins to a second, extended location for positioning said one of said bins at an aligning position extended horizontally relative to said plurality of vertically arranged bins;

driving means for moving said bins along said guide means; and sheet aligning means disposed in the vicinity of the second extended location of said second guide portion for adjusting sheets transported to said one of said bins which has been guided along said second guide portion to said aligning position.

10. The sheet sorting device as claimed in claim 9 further comprising a stapler disposed adjacent to said sheet aligning means for stapling the sheets aligned by said sheet aligning means.

11. The sheet sorting device as claimed in claim 9, wherein said sheet aligning means comprises a paddle wheel formed by a shaft and radially-arranged paddles for pressing the sheets by the rotation thereof.

12. A sheet sorting device comprising:

a plurality of bins to which sheets are to be accommodated at a sheet accommodating position;

moving means for moving each of said bins to a sheet aligning position;

aligning means for aligning a sheet on a bin at said sheet aligning position every time the sheet is accommodated; and means for positioning said bins and said sheet aligning means relative to one another such that one of said bins accommodates a sheet at said sheet accommodating position while another bin is at said sheet aligning position for alignment by said aligning means.

13. The sheet sorting device as claimed in claim 12 further comprising stapling means disposed in the vicinity of said aligning means for stapling the sheets aligned by said aligning means.

14. The sheet sorting device as claimed in claim 12, wherein each bin has an alignment reference portion formed by adjacent two sides thereof and said aligning means aligns the sheets by pressing the sheets to said reference portion.

* * * * *